US005992890A

United States Patent [19]

Simcox

[11] Patent Number: 5,992,890

[45] Date of Patent: Nov. 30, 1999

[54] METHOD OF PRESCRIBING PHARMACEUTICALS AND ARTICLE OF COMMERCE THEREFOR

[75] Inventor: Steven P. Simcox, Westfield, N.J.

[73] Assignee: Medical Media Information BV, Naarden, Netherlands

[21] Appl. No.: 08/879,647

[22] Filed: Jun. 20, 1997

[51] Int. Cl.[6] ..... B42D 11/00

[52] U.S. Cl. ..... 283/66.1; 283/900

[58] Field of Search ..... 283/62, 67, 900, 283/61, 74, 75, 69, 70, 66.1; 434/262; 281/2, 5

[56] References Cited

U.S. PATENT DOCUMENTS

| | | | |
|---|---|---|---|
| 1,588,964 | 6/1926 | Hutchins . | |
| 3,517,449 | 6/1970 | Frandsen et al. . | |
| 4,156,539 | 5/1979 | Davidson et al. | 283/900 X |
| 4,165,890 | 8/1979 | Leff | 283/900 X |
| 4,865,549 | 9/1989 | Sonsteby | 434/262 |
| 4,869,531 | 9/1989 | Rees | 283/67 |
| 4,918,604 | 4/1990 | Baum . | |
| 4,971,362 | 11/1990 | Lapsker . | |
| 4,991,877 | 2/1991 | Lieberman . | |
| 5,031,937 | 7/1991 | Nellhaus | 283/900 X |
| 5,248,280 | 9/1993 | Lockwood et al. | 462/19 |
| 5,261,702 | 11/1993 | Mayfield | 283/900 X |
| 5,324,077 | 6/1994 | Kessler et al. | 283/900 X |
| 5,433,483 | 7/1995 | Yu | 283/58 |
| 5,628,530 | 5/1997 | Thornton | 283/900 X |
| 5,636,873 | 6/1997 | Sonsteby | 283/900 X |
| 5,642,906 | 7/1997 | Foote et al. | 283/67 |
| 5,720,502 | 2/1998 | Cain | 283/900 X |
| 5,752,723 | 5/1998 | Robertson | 283/900 X |
| 5,755,462 | 5/1998 | Lupi | 283/900 X |
| 5,799,981 | 9/1998 | Tung et al. | 283/900 X |
| 5,803,498 | 9/1998 | Tung et al. | 283/900 X |
| 5,803,499 | 9/1998 | Tung et al. | 283/900 X |

FOREIGN PATENT DOCUMENTS 1122139 9/1956 France .

*Primary Examiner*—Willmon Fridie, Jr.
*Attorney, Agent, or Firm*—Hoffmann & Baron, LLP

[57] ABSTRACT

A prescription medium which provides visual correlation between a bio-affecting agent being prescribed and the application of a bio-affecting agent being prescribed. The prescription medium includes an entry space for prescriber identification, an entry space for identification of a patient, an entry space for identification of the bio-affecting agent being prescribed, and a plurality of visual indicia which identify the application for a class of agents. In completing the prescription medium, a prescriber selects one of the plurality of the indicia which properly correlates the bio-affecting agent being prescribed to its associated application. At the point where the pharmaceutical is being dispensed, the pharmacist again correlates the bio-affecting agent identified as that being prescribed with the selected indicia to confirm that the pharmaceutical being dispensed is that which is prescribed.

13 Claims, 3 Drawing Sheets

METHOD OF PRESCRIBING PHARMACEUTICALS AND ARTICLE OF COMMERCE THEREFOR

BACKGROUND OF THE INVENTION

The present invention relates generally to prescription media for prescribing bio-affecting agents, and more particularly, to a prescription medium having a plurality of visual indicia associated with the application of bio-affecting agents.

In the practice of medicine, certain bio-affecting agents, such as antibiotics, antihistamines, pain suppressing medicaments, anti-inflammatory medicaments and the like, are only available to a patient by prescription prepared by a medical professional, such as a doctor. In many, if not most cases, the prescribing professional makes the prescription via a prescription medium which is provided to a point of supply, such as a retail pharmacy, and the prescribed bio-affecting agent is dispensed in accordance with the prescription. Such bio-affecting agents will hereinafter be referred to as pharmaceuticals.

Typically, a doctor hand writes information into a prescription medium indicating the pharmaceutical name and required dosage. The most common prescription medium is a pad with preprinted prescriber information and entry spaces to identify the patient and the pharmaceutical being prescribed. Often, the indications are written in abbreviated format and are difficult to decipher due to the characteristics of the doctor's handwriting. These factors often make it difficult for a pharmacist, charged with dispensing the pharmaceutical, to determine the proper substance to dispense. In a worst case, the pharmacist confuses two pharmaceuticals which are of different classes of bio-affecting agents. This results in the dispensing of a pharmaceutical which is at best ineffective and at worst dangerous to the patient.

U.S. Pat. No. 4,918,604 to Baum discloses a method of graphically depicting a pharmaceutical to be dispensed. The Baum reference employs a computer system which controls a color graphic printer. The pharmacist, after receiving a completed prescription medium, enters information from the prescription medium into the computer which then directs the color printer to create a label for the pharmaceutical container. The printed label includes a color graphic illustrating the proper substance to be dispensed. While the Baum reference aids a pharmacist and patient in matching the substance dispense to the label, this reference does not alleviate the previously described risk associated with the pharmacist incorrectly interpreting the information entered on the prescription medium.

U.S. Pat. No. 4,991,877 to Lieberman discloses a system for conveying drug information to a consuming patient. The Lieberman reference employs a plurality of pre-printed cards which include information regarding specific pharmaceuticals. The cards include graphical icons to assist in the conveyance of information to the consumer about a selected pharmaceutical. However, the Lieberman reference is not directed to prescription media nor does it provide a method to alleviate the risk of a prescription being improperly interpreted resulting in the wrong pharmaceutical being dispensed.

U.S. Pat. No. 4,971,362 to Lapsaker, U.S. Pat. No. 1,588,964 to Hutchkins and French Patent No. 1,122,133 to S.E.P.P. each describe printed prescription media for use by a medical professional in conveying prescription information to a pharmacist. However, none of these references provide means or a method for alleviating the risk of misconstruing the indications written on the prescription medium to prevent incorrect dispensing of the pharmaceutical.

The present invention overcomes the shortcomings found in the prior art by providing prescription media which includes a plurality of visual indicia to give positive correlation between a prescribed pharmaceutical and the application of that pharmaceutical.

SUMMARY OF THE INVENTION

The present invention provides prescription media which allows for visual correlation between a prescribed pharmaceutical and the intended application of that pharmaceutical. The prescription media includes an entry space for a prescriber identification, an entry space for patient identification, an entry space for identification of a pharmaceutical being prescribed and a plurality of visual indicia. Each of the plurality of indicia serves to identify an application for a class of pharmaceuticals. After a prescriber selects the indicia that identifies the application of the specific pharmaceutical being prescribed, a pharmacist dispensing the pharmaceutical can correlate the selected pharmaceutical to the selected pharmaceutical's bio-activity.

In one preferred embodiment of the present invention, the prescription medium is fabricated as a printed form with visual indicia printed as pictorial icons readily identifying selected classes of pharmaceuticals.

In an alternate embodiment of the present invention, the prescription medium takes the form of an electrically displayed form wherein visual indicia identifying selected classes of pharmaceuticals are electrically displayable, selectable and printable graphical icons. In a preferred electronic embodiment of the present invention a hand held remote computer terminal is employed for data entry and to display and select the graphical icons. The hand held remote computer includes means for electronically communicating to a host computer which facilitates verification of the data entry and icon selection and provides for printing and electronic communication with a remote pharmaceutical distribution point.

Prescription media formed in accordance with the present invention provides visual indicia indicative of a prescribed pharmaceutical. The visual indicia provides a safer medium for the prescribing of pharmaceuticals. The visual indicia allows a pharmacist to quickly and easily confirm a prescription by verifying the correlation between a prescribed pharmaceutical and an application icon selected to match the pharmaceutical. The prescription medium thereby reduces the risk of incorrectly dispensing a prescribed pharmaceutical and enhances patient safety accordingly.

For better understanding of the present invention, together with other and further advantages, references made to the following description taken in conjunction with the accompanying drawings, and its scope will be pointed out in the appended claims.

DETAILED DESCRIPTION OF THE INVENTION

Figure 1:
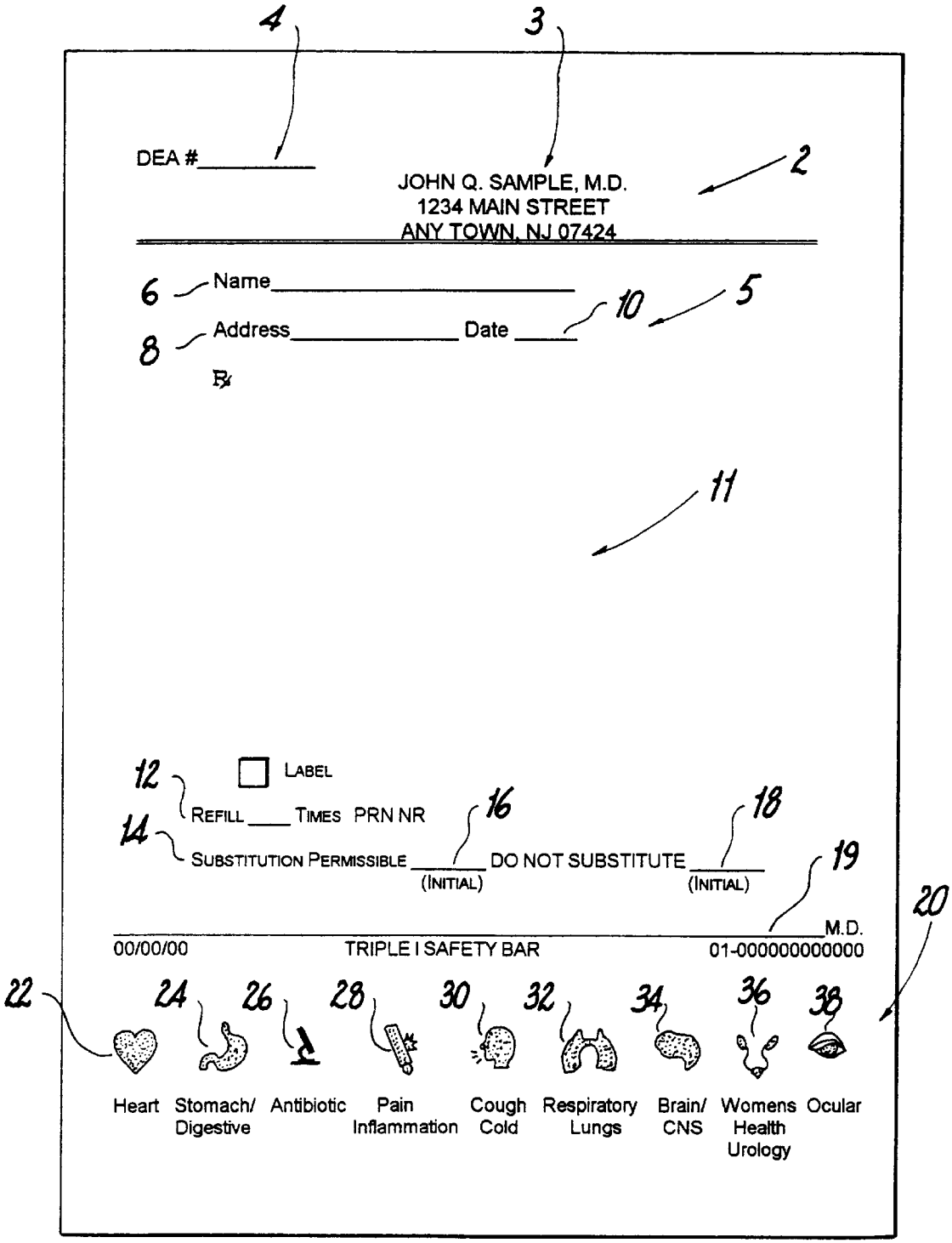
FIG. 1 is a pictorial diagram of a preferred embodiment of the prescription medium formed in accordance with the present invention.

Referring to the drawings, FIG. 1 illustrates the first embodiment of a prescription medium of the present invention. The prescription medium includes several elements including a section for prescriber information 2, a section for patient information 5, and a section for pharmaceutical information 11. The prescription medium further includes a graphical indicia section 20 which includes a plurality of icons representing selected pharmaceutical applications.

The prescriber information section preferably includes an entry space for prescriber (i.e., doctor) identification information 3 as well as an entry space 4 for the doctor's Drug Enforcement Agency (DEA) number. This information may be pre-entered for the convenience of the doctor or blank entry spaces for this information may be provided.

The patient information section 5 preferably includes entry spaces for the patient's name 6, the patient's address 8 and a date the prescription is being completed 10.

The pharmaceutical information section 11 includes a large blank entry space for the name and description of the pharmaceutical being prescribed. The prescriber enters the pharmaceutical information and required dosage information in this blank entry space. The pharmaceutical information section 11 may further include pre-entered indications for refilling the prescription 12 and substitution information 14. In the embodiment illustrated in FIG. 1, the substitution information 14 includes two blank spaces 16,18 for the prescriber to initial, in the alternative, whether substitution of the identified pharmaceutical is permissible or not. This is typically used to indicate whether a generic pharmaceutical may be dispensed. Alternatively, a check box indicating to dispense the medication as written (DAW) may be provided.

The prescription medium further includes an entry space 19 for the prescriber to sign the prescription medium. This serves to authenticate the validity of the prescription.

An important aspect of the present invention is the graphical indicia section 20 of the prescription medium. Generally, pharmaceuticals may be categorized in terms of their application. For example, Penicillin, Amoxicillin and Erythromycin all may be categorized as antibiotics. Similarly, Demerol, Morphine, Codeine and Acetaminophen may be categorized by their application as pain suppressants. The graphical indicia section 20 preferably includes icons representing selected significant classes of pharmaceuticals to depict a prescribed pharmaceutical's intended application. These indicia can be provided by text, graphical icons or preferably a combination of text and graphical icons.

In a preferred embodiment of the graphical indicia section 20, illustrated in FIG. 1, several graphical indicia are illustrated. For those pharmaceuticals which are prescribed for heart and circulatory related conditions, a heart shaped icon 22 is provided with the text "Heart" proximate to this icon. For those pharmaceuticals which are prescribed for stomach and digestive track disorders, a graphical illustration of a stomach 24 is provided along with the illustrative text "Stomach/Digestive track." As previously described, a common class of pharmaceuticals is antibiotics. This class of pharmaceuticals is illustrated by the graphical icon of a microscope 26 and the illustrative text "Antibiotic."

Another common classification of pharmaceuticals include those which serve to limit pain and reduce inflammation. The prescription medium preferably includes a graphical icon of a bone emitting a flame along with the exemplary text "Pain/Inflammation." For pharmaceuticals whose application is the treatment of coughs, colds and the like, the graphical indicia section 20 further includes a graphical icon of a persons head 30 including discharge from the mouth and nose area. This icon has associated exemplary text "Cough/Cold."

In a similar fashion, icons are included for classes of pharmaceuticals for the treatment of respiratory/lung disorders, brain/central nervous system disorders, women's health/urology and ocular disorders. These classes of pharmaceuticals are graphically illustrated by: a set of lungs 32, a pictorial representation of a brain 34, a pictorial representation of a set of ovaries 36 and a graphical representation of an eye 38, respectively. Representative text is also included for each of these icons.

It will be appreciated that the described list of applications, icons and text is merely exemplary and that additions, deletions and substitutions to this list are contemplated as within the scope of the present invention.

In accordance with a method of using the prescription media of the present invention, the prescriber will complete the patient identification section 5 and pharmaceutical information section 11 in a conventional manner. The prescriber will then select one of the graphical icons from the graphical indicia section 20 which represents the desired application for the prescribed pharmaceutical. Upon receiving the completed prescription medium, a pharmacist will interpret the pharmaceutical identification and will confirm this interpretation by correlating the specific pharmaceutical identified in the pharmaceutical identification section 111 with the application being identified in the graphical indicia section 20. In the event that the pharmaceutical identified by the pharmacist does not serve the purpose illustrated by the selected graphical icon, the pharmacist will immediately know that the pharmaceutical selected is incorrect. This would prevent the pharmacist from dispensing a pharmaceutical from a differing class of pharmaceuticals, thereby preventing a potentially dangerous situation for the patient.

Figure 2:
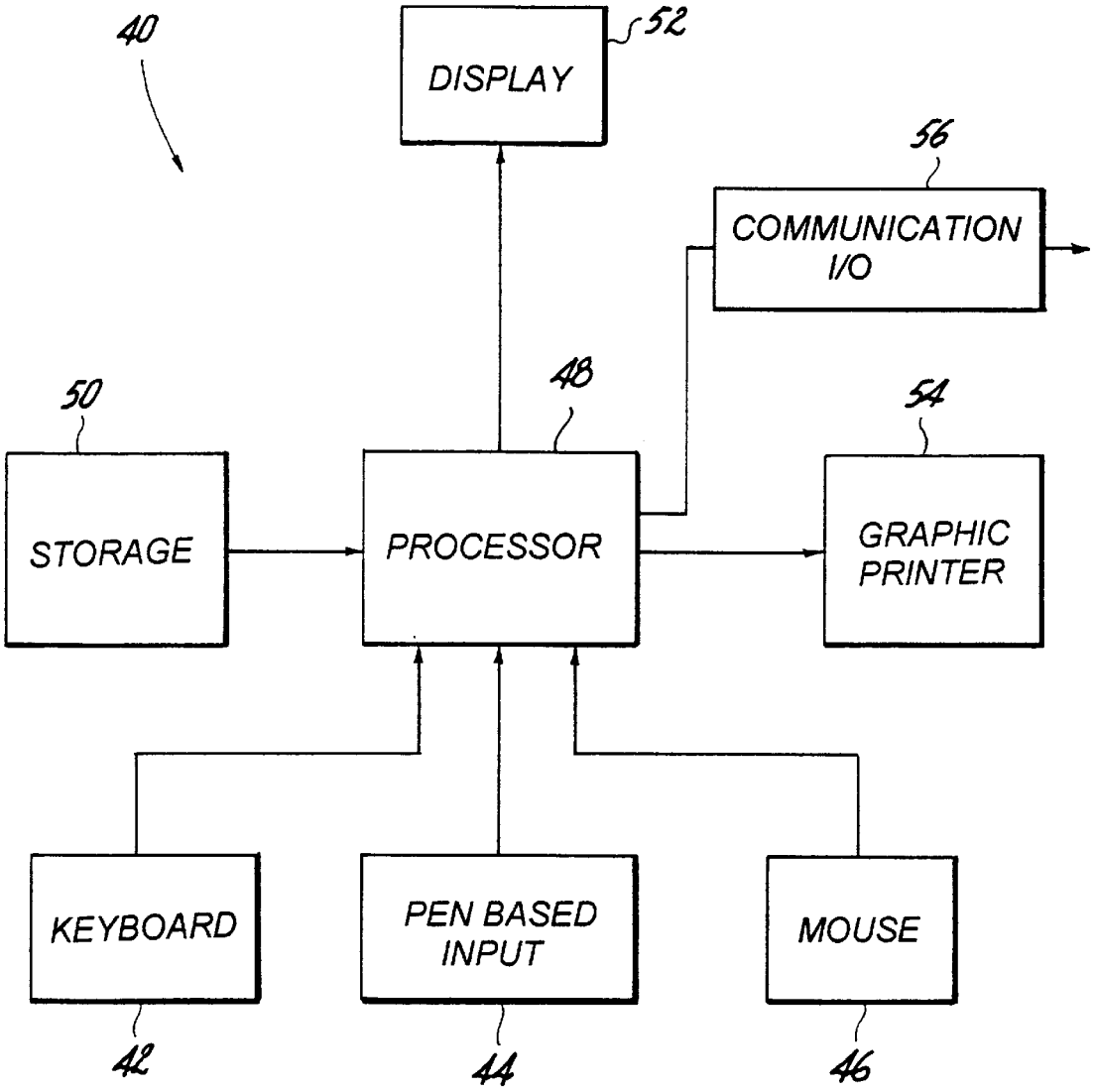
FIG. 2 is a block diagram of an electronic system suitable for use in implementing an electronic embodiment of the prescription medium formed in accordance with the present invention.

The described prescription medium of the present invention can be implemented as a substrate for writing, such as prescription pads known in the art. However, the present invention may also be implemented with electronic medium. In an electronic embodiment of the present invention, the previously described form (FIG. 1) is created and displayed by a computer system 40 such as those illustrated in FIGS. 2 and 3. The prescriber electrically enters the prescription information in a conventional fashion such as through a keyboard 42, touch sensitive screen 44, or by use of a digital pointer 46 (i.e., a mouse). The graphical indicia section 20 is implemented as electronically displayable graphical icons which are electrically selectable in any manner known in the computer art.

Preferably, the computer system includes data processing means 48 and digital storage capabilities 50 which cooperate to correlate the information entered into the prescription identification section 11 to the selected graphical icon 20. The computer 40 preferably provides audio and/or visual indications on a display 52 to the prescriber if a lack of correlation exists. If proper correlation exists between the pharmaceutical prescribed and the selected application icon for this pharmaceutical, the completed prescription medium can then be printed using a graphic printer 54 and electrically transmitted using a digital communicator (i.e., modem) 56 to a pharmacist, or other point of pharmaceutical distribution.

Figure 3:
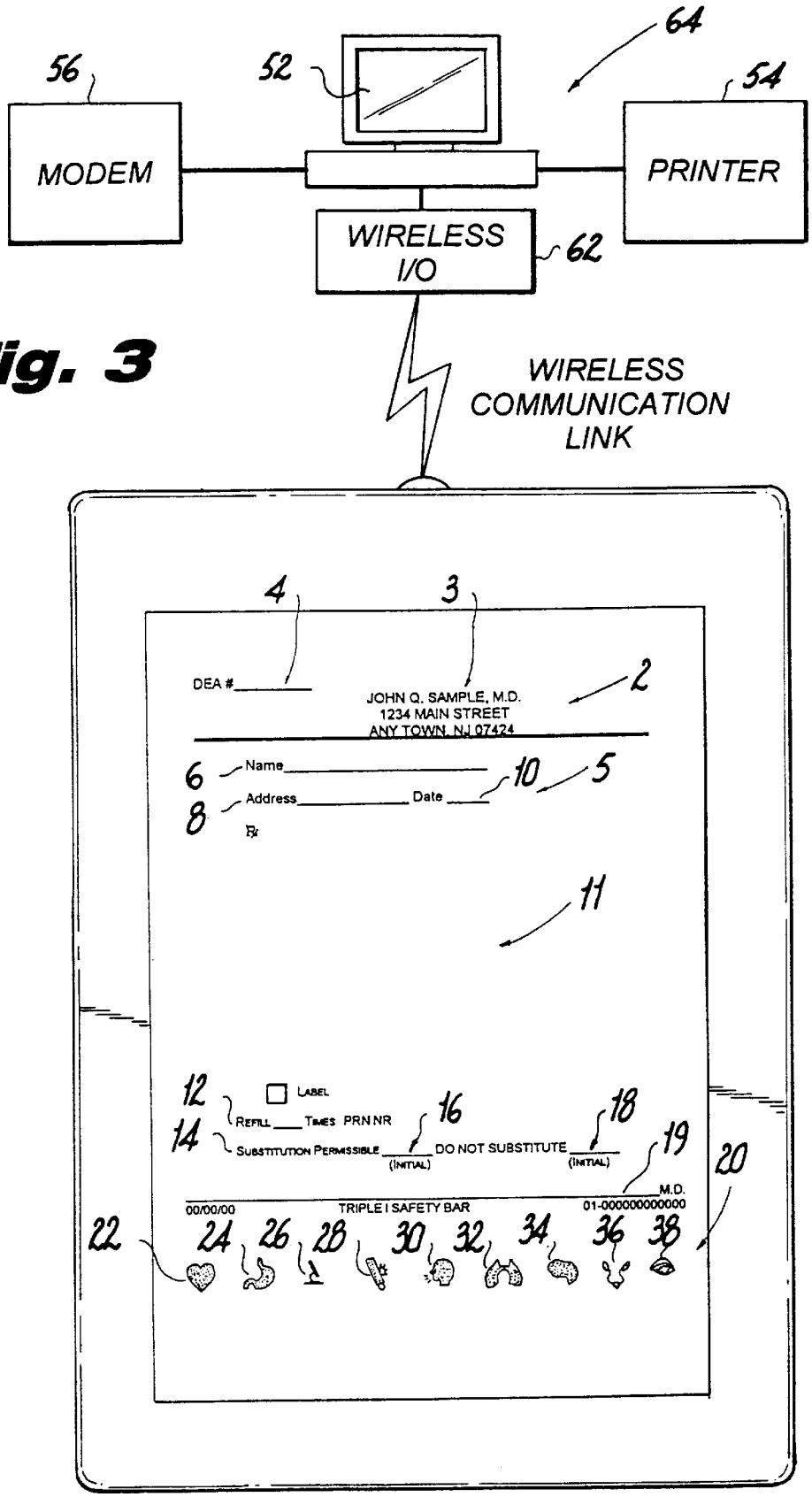
FIG. 3 is a diagram of a preferred computer system, featuring a hand held pen-based computer terminal, formed in accordance with the present invention.

FIG. 3 illustrates a preferred electronic embodiment of the prescription media system formed in accordance with the present invention. The system includes a hand held computer terminal or personal digital assistant (PDA) 60 which preferably includes a pen based interface with handwriting recognition software. An exemplary device is the Newton® palm based computer manufactured by Apple® computer (Newton and Apple are registered trademarks of Apple Computer, Inc.). The prescriber enters data into the fields of the form illustrated in FIG. 1 using the penbased interface as if it were a conventional paper pad. Upon completion of the entry, the PDA 60 verifies the correlation between the prescribed pharmaceutical and selected application icon. If correct, the PDA 60 transmits the prescription information via a wireless communication link 62 to a stationery host computer system 64. Alternatively, the PDA 60 can transmit unverified data to the host computer system 64 for subsequent verification, if desired. The wireless link 62 may take the form of a short range infrared optical link or short range radio link within the prescriber office, or may be a link to a wide area radio network which forwards the prescription information directly to the point of pharmaceutical distribution. The host computer system 64 preferably includes a graphics printer for generating a printed copy of the completed prescription medium for the patient.

While it has been described what are presently believed to be the preferred embodiments of the invention, those skilled in the art would realize that various changes and modifications may be made to the invention without departing from the spirit of the invention, and it is intended to claim all such changes and modification as forward in the scope of the invention.

What is claimed:

1. A prescription device which provides visual correlation to a pharmacist between a pharmaceutical being prescribed and a class related to an intended medical application of the pharmaceutical being prescribed, the prescription device comprising:

a medium;

an entry space on said medium for a prescriber identification;

an entry space on said medium for a patient identification;

an entry space on said medium for an identification of the pharmaceutical being prescribed; and a plurality of indicia on said medium for providing enhanced visual verification to the pharmacist of the intended medical application of the pharmaceutical being prescribed, said plurality of indicia including icons representing classes of medical applications of pharmaceuticals.

2. A prescription device as defined by claim 1, wherein said medium is a substrate for marking with a writing instrument.

3. A prescription device as defined by claim 1, wherein said plurality of indicia indicate at least one of heart, stomach, antibiotic, pain, cough, cold, respiratory, brain, women's health urology and ocular as the intended medical application of the pharmaceutical being prescribed.

4. A prescription device as defined by claim 1, wherein said medium is an electronically generated form.

5. A prescription device as defined by claim 4, further comprising a printer for printing said electronically generated form on a substrate.

6. A prescription device as defined by claim 4, wherein said plurality of indicia indicate at least one of heart, stomach, antibiotic, pain, cough, cold, respiratory, brain, women's health urology and ocular as the intended medical application of the pharmaceutical being prescribed.

7. A prescription device which provides visual correlation to a pharmacist between a pharmaceutical being prescribed and a class related to an intended medical application of the pharmaceutical being prescribed, the prescription device comprising:

a medium;

an entry space on said medium for a prescriber identification;

an entry space on said medium for a patient identification;

an entry space on said medium for an identification of the pharmaceutical being prescribed; and a plurality of indicia on said medium for providing enhanced visual verification to the pharmacist of the intended medical application of the pharmaceutical being prescribed, said plurality of indicia including text representing classes of medical applications of pharmaceuticals.

8. A prescription device as defined by claim 7, wherein said medium is a substrate for marking with a writing instrument.

9. A prescription device as defined by claim 7, wherein said plurality of indicia indicate at least one of heart, stomach, antibiotic, pain, cough, cold, respiratory, brain, women's health urology and ocular as the intended medical application of the pharmaceutical being prescribed.

10. A prescription device as defined by claim 7, wherein said medium is an electronically generated form.

11. A prescription device as defined by claim 10, further comprising a printer for printing said electronically generated form on a substrate.

12. A prescription device as defined by claim 10, wherein said plurality of indicia indicate at least one of heart, stomach, antibiotic, pain, cough, cold, respiratory, brain, women's health urology and ocular as the intended medical application of the pharmaceutical being prescribed.

13. A prescription device as defined by claim 7, wherein said plurality of indicia include icons.

* * * * *